US007934626B2

(12) United States Patent
Choi et al.

(10) Patent No.: US 7,934,626 B2
(45) Date of Patent: May 3, 2011

(54) AIRLESS DISPENSING PUMP CONTAINER WITH AN AIRTIGHT PUSH DOWN TYPE NOZZLE HEAD

(76) Inventors: Hee Jin Choi, Seoul (KR); Yu Kwang Oh, Seoul (KR); Won hee Lee, Seoul (KR)

( * ) Notice: Subject to any disclaimer, the term of this patent is extended or adjusted under 35 U.S.C. 154(b) by 493 days.

(21) Appl. No.: 12/062,862

(22) Filed: Apr. 4, 2008

(65) Prior Publication Data

US 2008/0257911 A1 Oct. 23, 2008

(51) Int. Cl.
*B65D 88/54* (2006.01)

(52) U.S. Cl. ..... 222/320; 222/321.7

(58) Field of Classification Search ..... 222/320, 222/256, 321.1, 321.7, 321.9, 340, 257, 311, 222/207, 378–380
See application file for complete search history.

(56) References Cited

U.S. PATENT DOCUMENTS

| | | | | |
|---|---|---|---|---|
| 5,505,343 | A * | 4/1996 | Knickerbocker | 222/321.1 |
| 5,649,649 | A * | 7/1997 | Marelli | 222/321.2 |
| 5,720,419 | A * | 2/1998 | Li | 222/321.2 |
| 2009/0008413 | A1 * | 1/2009 | Choi et al. | 222/256 |

* cited by examiner

*Primary Examiner* — Lien T Ngo
(74) *Attorney, Agent, or Firm* — John K. Park; Park Law Firm

(57) ABSTRACT

An airless dispensing pump container with an airtight nozzle head of a push down type capable of discharging a fixed amount of content is disclosed, in which a vacuum sealing function is enhanced in the whole structure of the present invention, and a content opening and closing plate of a content opening and closing valve member in the construction of a content discharge part of a nozzle head is automatically opened and closed, along with a reliable discharge of the content, and a reverse flow and leakage are prevented by improving a structure of a content pump piston which sucks and transfers the content. When a pump cylinder is slanted at a certain angle along with the content storing container or in case of a content having high viscosity, it is possible to improve the operation errors of the ball valve by providing an inventive structure of the ball valve support installed at a lower side of the stem.

6 Claims, 8 Drawing Sheets

AIRLESS DISPENSING PUMP CONTAINER WITH AN AIRTIGHT PUSH DOWN TYPE NOZZLE HEAD

TECHNICAL FIELD

The present invention relates to an airless dispensing pump container with an airtight push down type nozzle head that is capable of discharging a fixed amount of content, while being engaged at a content storing container which is able to store various cosmetic contents.

BACKGROUND ART

Generally, in case of liquid cosmetic, a pump dispenser is used so as to easily discharge cosmetic stored in a content storing container based on a manual pumping operation by the user.

The above pump dispenser for discharging stored liquid contents that is based on a pumping operation is made in various types. Here, a nozzle head up and down type pump dispenser container is more often generally used. According to a nozzle head up and down type, a vertical or horizontal nozzle head compresses the content pump piston connected to a nozzle head in a vertical or horizontal state by an external force thereby discharging its content. After the above operation is performed, it returns to original state with the help of a return spring and the content of the storage container is sucked into the cylinder. In another type of dispenser structure, as a nozzle head moves down in a vacuum seal state, the content compression piston received in the content storing container moves down by the height corresponding to the discharged amount of content.

In the former case, an external air may be inputted into the content storing container after the content is discharged, so that the negative pressure in the container is removed. In the later case, since an external air is not inputted into the content storing container after the content is discharged, it keeps a vacuum state all the time.

In the former case, since the external air (in particular, oxygen) resides in the content storing container at all the times, the content may give quality-changes and may be easily oxidized and decayed. So, in the former case is not actually applied to the contents which contain high pure extracts or vitamin components.

The later case is generally used for the prevention of oxidation or decay of high quality cosmetic which does not need antiseptic substances. The present invention corresponds to the later case. When the content is discharged, the nozzle head and the content compression piston move down step by step.

According to the conventional nozzle head down pump dispenser container, there is a Korean patent registration number 10-0525455 "fixed amount discharge structure of nozzle head down vacuum type cosmetic container" (hereinafter referred to conventional art 1) which is invented by the applicant of the present invention. There is a Korean patent publication number 1999-0066973 "apparatus for discharging liquid or paste substance and method for assembling the same" (hereinafter referred to conventional art 2).

In addition, there is a Germany patent number DE295066826U "Abgabepumpe aus Kunststoff für pastenartige stoffe" which is designed to enhance the nozzle air sealing state of a nozzle head (hereinafter referred to conventional art 3). There is a PCT number WO 2006-116312 A2 "dispenser having air tight spout" (hereinafter referred to conventional art 4) in which an elastic member is installed at the nozzle hole.

According to the conventional art 1, there is not disclosed any element between the content collection chamber and the container housing for blocking the content. So, the content of the collection chamber reverse-flows into the content storing container, so that it is impossible to implement a fixed discharge amount of the liquid since there is not any reverse flow prevention function. In particular, the content has low viscosity, when the content is filled via the lower side of the container housing, and the lower side of the same is capped with the lower container, the container housing may have a certain level of pressure therein, so that the content may leak via the nozzle hole since the content reverse-flows.

According to the conventional art 2, it is designed so that a certain amount of content may be discharged at one time by the pressing pressure of the nozzle. So, it is impossible to implement a fixed amount of discharge. In case if the content has a low viscosity, the content may leak via the nozzle hole due to a reverse flow of discharge. Since the opening of the nozzle hole of the nozzle head is open all the time, the air may be inputted into the interior of the pump via the nozzle hole, so that the content may be solidified when contact with external air, whereby the content may not be smoothly discharged.

According to the conventional art 3, a plug type discharge valve is engaged at the nozzle hole of the nozzle head. The discharge valve is made of an elastic material, and it has an opening and closing function. However, In the above conventional art 3, since large parts of the front end of the discharge valve is exposed due to the construction of the plug type discharge valve, a certain gap may be formed between the discharge valve and the valve hole when it receives an external pressure or the certain pressure difference occurs between the inner and outer atmospheres of the pump, so that a certain foreign substance or air may easily penetrate into the inside of the pump or the content of the inside of the pump may be forced to pressurize the discharge valve, whereby the liquid can and may leak.

In addition, the valve operation is performed for mainly discharging the content of the container. So, it is impossible to accurately control the flow rate and velocity of the content. When the content having low viscosity is discharged, the content may be sprayed in a radial direction, so that it may run down along the nozzle head. In the above art, the discharge valve should be engaged at the nozzle hole in a flow direction of the liquid, but the discharge valve is engaged at a slanted direction, so that the content that has a low viscosity may be discharged in not fixed one direction thereby causing many problems in use.

According to the conventional art 4, the content discharge hole of the nozzle tip is formed in a slit shape, so that it is difficult to keep a sealed state of the discharge hole. The elastic force of the discharge hole may lose its elastic property by a long time use, so that the slit members may remain in the open state. It is preferred that the split portions of the discharge hole are closely contacted by means of constant pressure. However, when the pressure is not uniform, the discharge states of the content is also not uniform due to the discharge pressure, namely, it is slanted in one direction, so that it is impossible to obtain a uniform discharge direction in the above conventional art.

DISCLOSURE OF THE INVENTION

Accordingly, it is an object of the present invention to provide an airless dispensing pump container with an airtight push down type nozzle head capable of discharging a fixed amount of content which overcomes the problems encountered in the conventional art stated above.

It is another object of the present invention to provide an airless dispensing pump container with an airtight push down type nozzle head capable of discharging a fixed amount of content in which a vacuum sealing function is enhanced in the whole structure of the present invention, and a content opening and closing valve member of a content discharge part provided at a nozzle head is automatically opened and closed, along with a reliable discharge of the content, and a reverse flow and leakage are prevented by improving the structure of the content pump piston which sucks and transfers the content. When the pump cylinder is slanted at a certain angle along with the content storing container or in case of the content having high viscosity, it is possible to improve the operation errors of the ball valve by providing an inventive structure for the ball valve support installed at the lower side of the stem.

To achieve the above objects, there is provided an airless dispensing pump container with an airtight push down type nozzle head which comprises the content discharge part which is installed at the nozzle engaging hole of the nozzle head; the efficient content pump piston which is provided at an inner wall of the pump cylinder; and a ball valve support which is engaged at the lower side of the stem.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

Figure 1:
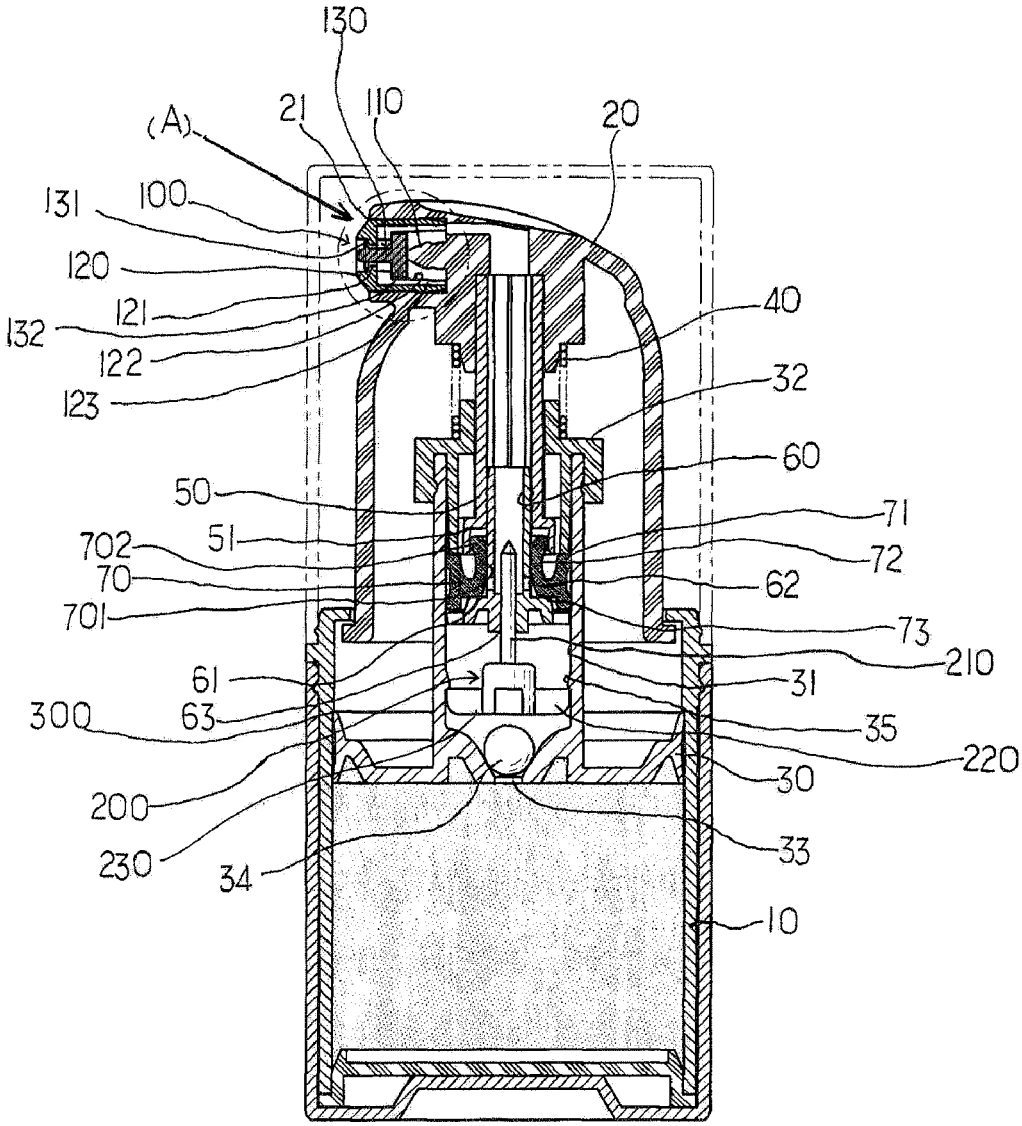
FIG. 1 is a cross sectional view illustrating a state that a nozzle head is moved up in a pump dispenser container, and first and second content inlet holes and a content opening and closing plate of an opening and closing member are closed according to the present invention.

The preferred embodiment of the present invention will be described with reference to the accompanying drawings.

In an airless dispensing pump container with an airtight nozzle head of a push down type which includes a content storing container 10 for storing liquid content therein, a nozzle head 20 which is assembled at an upper side of the content storing container 10 and has a nozzle engaging hole 21, a content compression piston 30 which is received in the content storing container 10 and is formed at a lower side, a pump cylinder 31 which is provided at a center portion, a pump cylinder cap 32 which is covered on an upper side of the pump cylinder 31, a first content inlet hole 33 which is provided at a lower center of the pump cylinder 31, a ball valve 34 which opens and closes the first content inlet hole 33, a ball valve support shoulder 35 provided at a lower inner wall of the pump cylinder 31, a nozzle head return spring 40 which is installed between the nozzle head 20 and the pump cylinder cap 32, a pump piston shaft 50 which is fixedly assembled at an inner center of the nozzle head 20 and has a pump piston holder part 51 at a lower side, a step 60 which is fixed at a lower side of the pump piston shaft 50 and has a pump piston lower end contact surface 61, a second contact inlet hole 62, and a ball valve support guide rod insertion hole 63, a pump piston 70 which is inserted into the stem 60 and includes an insertion part 72 sliding up and down as being inserted into the stem 60, and a content opening and closing surface 73 formed at a lower surface, there is provided an airless dispensing pump container with an airtight nozzle head of a push down type which comprises a content discharge member 100 which is installed at a content discharge member engaging hole 21 of the nozzle head 20; a ball valve support 200 which is engaged at a lower side of the stem 60; and a content compression piston support shoulder 300 which is provided at an inner upper wall of the content storing container 10.

The content discharge member 100 comprises a valve member support protrusion 110 which is integral with the nozzle head 20 and is positioned at the center of the content discharge member engaging hole 21; a valve member cover body 120 which is fixedly inserted into the content discharge member engaging hole 21 and has a content discharge hole 121 at its front center portion; and a content opening and closing valve member 130 which is inserted into the valve member cover body 120 and is supported by means of the valve member support protrusion 110.

The valve member cover body 120 comprises a plurality of ribs 122 formed in its inner surface at regular intervals; and a plurality of content flow groves 123 formed between the ribs 22.

The content opening and closing valve member 130 comprises a content opening and closing plate 121 which is provided at its front side for opening and closing the content discharge hole 121 of the valve member cover body 120; and a support plate 132 which is supported by means of the valve member support protrusion 110.

The insertion part 72 of the pump piston 70 is formed in a "))(" shape in its cross section, with an intermediate portion of the same being defined as a first content discharge prevention surface 701, with an upper surface portion being defined as a second content discharge prevention surface 702.

The ball valve support 200 comprises a guide rod 210 which is inserted into a ball valve support guide rod insertion hole 63 of the stem 60; a plurality of ball valve support ribs 220 which are provided at a lower side of the guide rod 210; and a content path 230 which is provided between the ball valve support ribs 220.

The operation and effects of the present invention will be described.

In the present invention, the input of an external air or foreign substance is basically prevented, so that oxidation or decay of the content is prevented.

In addition, a fixed amount of content is discharged. In a state that the content compression piston 30 and the nozzle head 20 are assembled at the content storing container 10, a certain amount of content is inputted via the opened lower surface of the content storing container 10, and the lower side of the same is capped.

In a state that the content is stored in the above manner, when the content is discharged, the content compression piston 30 and the nozzle head 20 move down by the height corresponding to the amount of the discharged content.

As shown in FIG. 1, in a state that the content is stored in the content storing container 10, the upper wing portion of the content compression piston 30 supports the content compression piston support shoulder 300, so that the content compression piston 30 moves up no more. When the content is filled in the content storing container 10 via the lower surface of the container housing, and the lower side of the same is capped with the lower container, a certain pressure generates in the container housing, and the content compression piston 30 moves up, and the return spring 40 is compressed, and the content opening and closing surface 73 of the pump piston 70 is open. So, it is possible to prevent the problems that the content of the pump cylinder 31 is first discharged to the content discharge hole 131 via the second content inlet hole 62.

The content discharge member 100 is integrally formed with the nozzle head 20, and the valve member support protrusion 110 is provided at the center of the content discharge member engaging hole 21. As the valve member cover body 120 inserted with the content opening and closing valve member 130 is inserted into the content discharge member engaging hole 21, the content discharge member 100 is stable fixed. The support plate 132 provided in a backside of the content opening and closing valve member 130 is supported by means of the valve member support protrusion 110, so that the content opening and closing valve member 130 is stably fixed, while not moving and not being disengaged.

As shown in FIG. 1, the nozzle head 20 is fully moved up by the elastic force of the return spring 40. In this state, the piston shaft 50, the ball valve support 200 in which the guide rod 210 is inserted into the guide rod insertion hole 63 of the stem 60, and the pump piston 70 are moved up, and the ball valve 34 closes the first content inlet hole 33 by the weight of the same. The pump piston lower contact surface 61 inserted into the stem 60 and the content opening and closing surface 73 of the pump piston 70 contact closely with each other for thereby closing the second content inlet hole 62. The support rib 220 of the ball valve support 200 is supported by means of the ball valve support shoulder 35, so that it does not move up.

Figure 2:
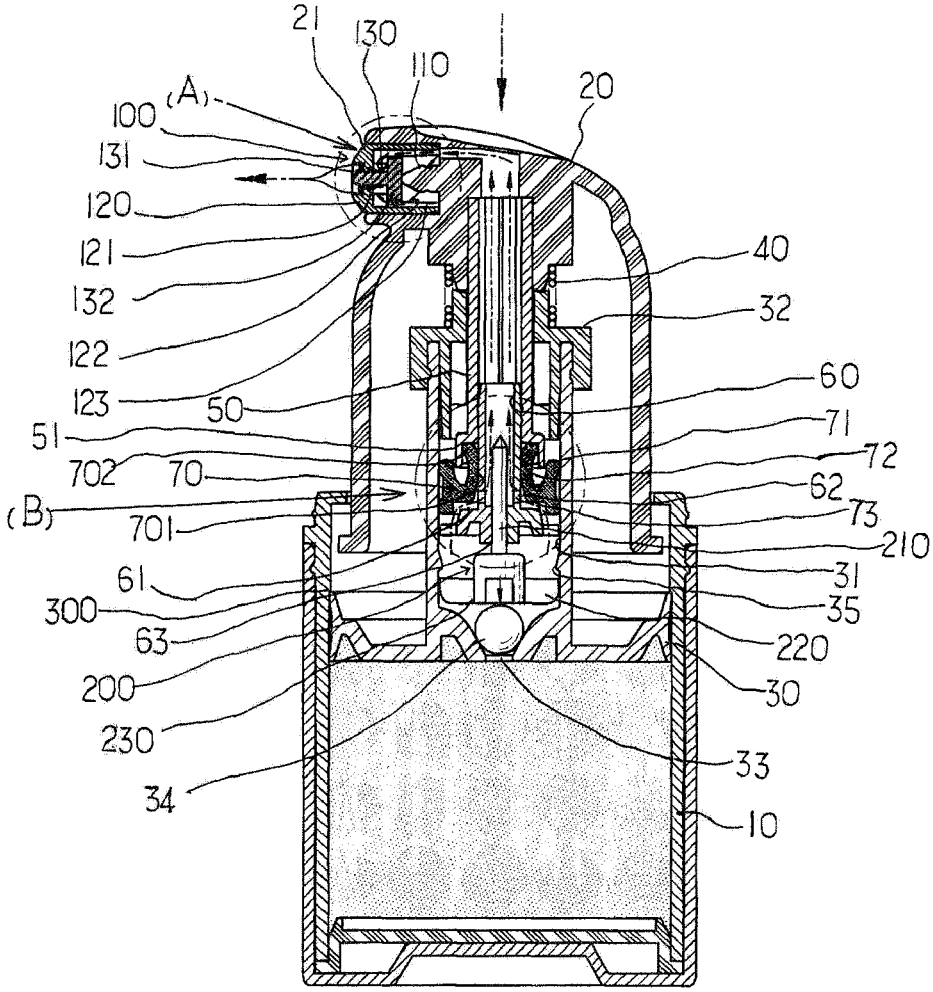
FIG. 2 is a cross sectional view illustrating a nozzle head keeps moving down so as to discharge the content in a pump dispenser container according to the present invention.
Figure 3:
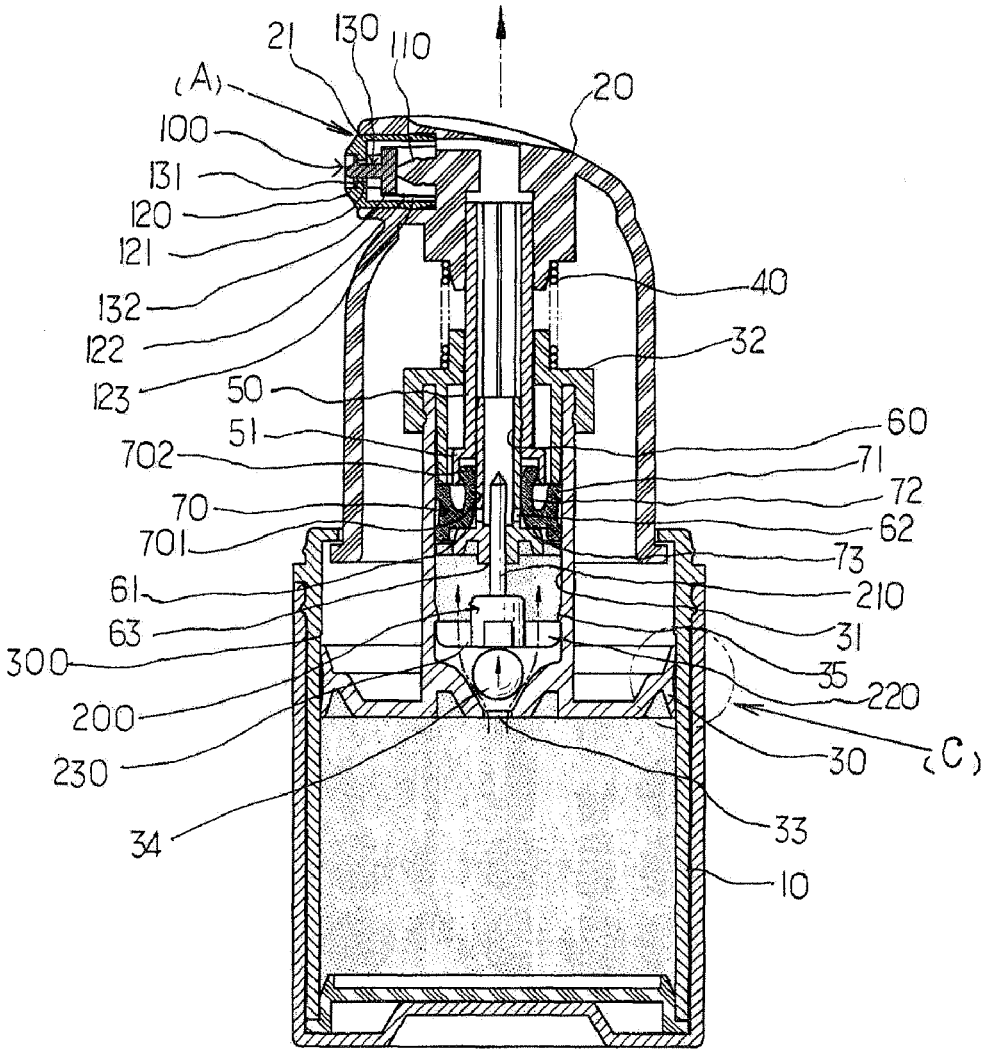
FIG. 3 is a cross sectional view illustrating a state that a discharge of a content is completed in a pump dispenser container, and a nozzle head moves up by a return spring, and a content is inputted into a pump cylinder, and a content compression piston is moved down according to the present invention.
Figure 4:
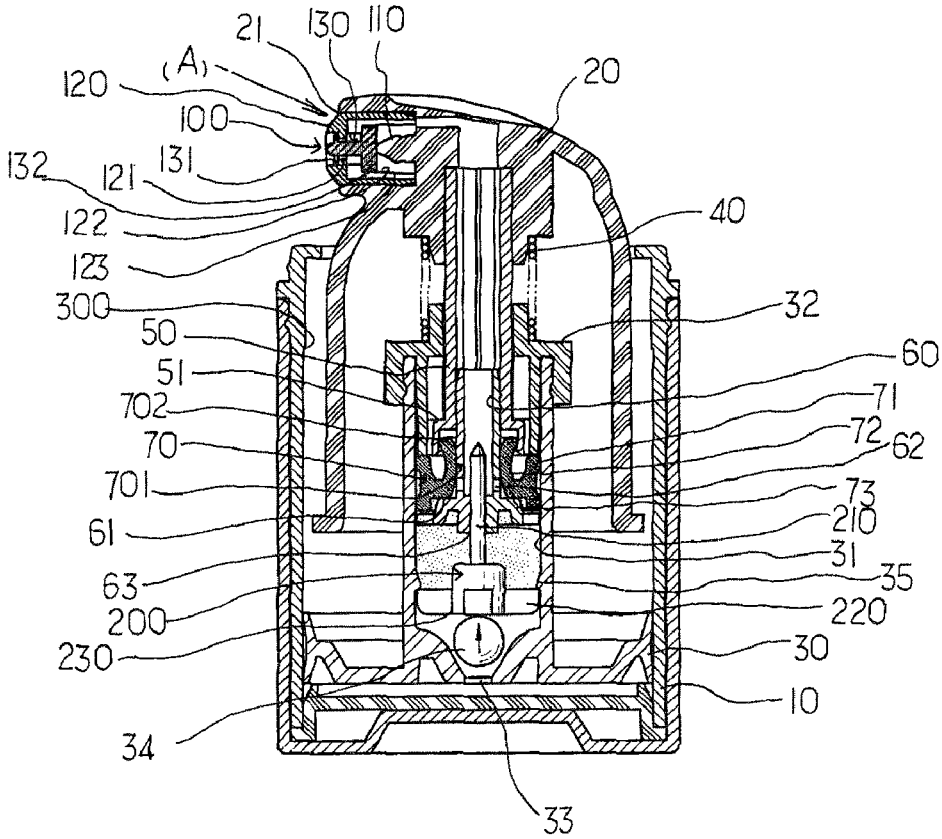
FIG. 4 is a cross sectional view illustrating a state that a content of a content storing container is fully discharged in a pump dispenser container according to the present invention.
Figure 5:
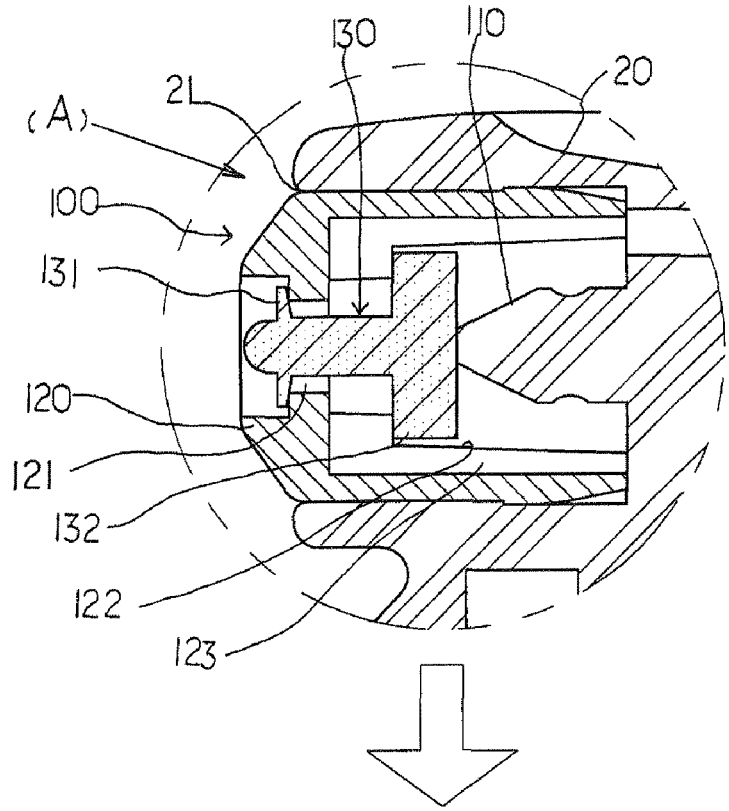
FIG. 5 is an enlarged cross sectional view illustrating a circular indication part A of FIG. 1 and a state that a content discharge valve member is closed according to the present invention.
Figure 6:
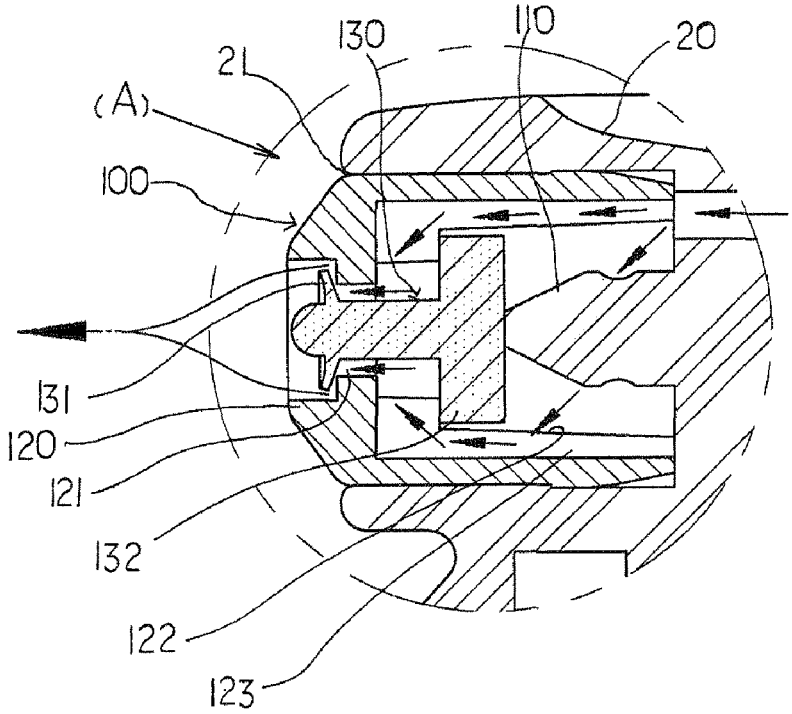
FIG. 6 is an enlarged cross sectional view illustrating a circular indication part A of FIG. 2 and a state that a content opening and closing plate of a content opening and closing valve member is open according to the present invention.
Figure 7:
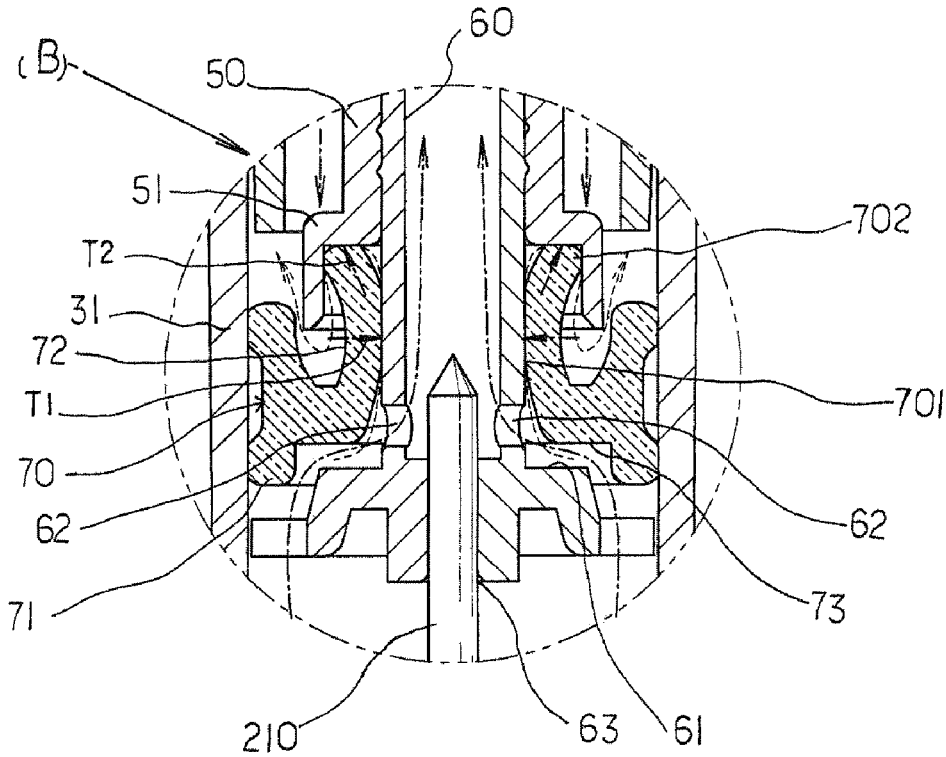
FIG. 7 is an enlarged cross sectional view illustrating a circular indication part B of FIG. 2 and an operation state of a content pump piston according to the present invention.
Figure 8:
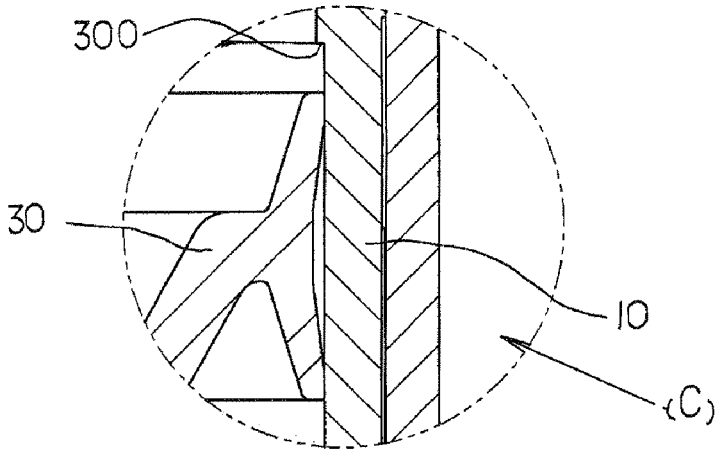
FIG. 8 is an enlarged cross sectional view illustrating a circular indication part C of FIG. 3 and an operation state of a content pump piston according to the present invention.
Figure 9:
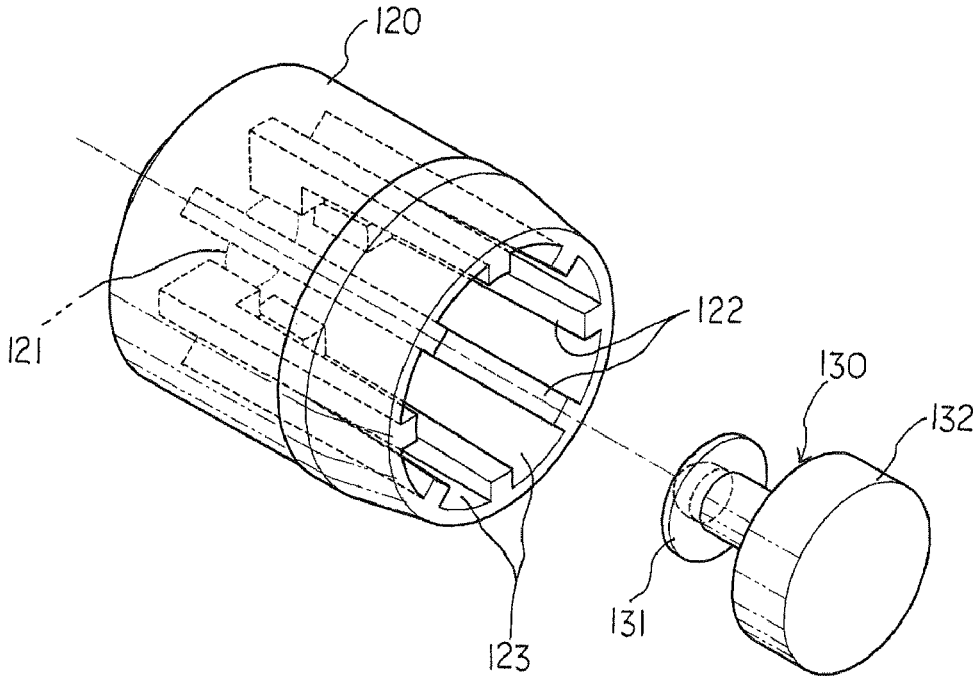
FIG. 9 is a disassembled perspective view illustrating a content opening and closing valve member cover body and a content opening and closing valve member according to the present invention.
Figure 10:
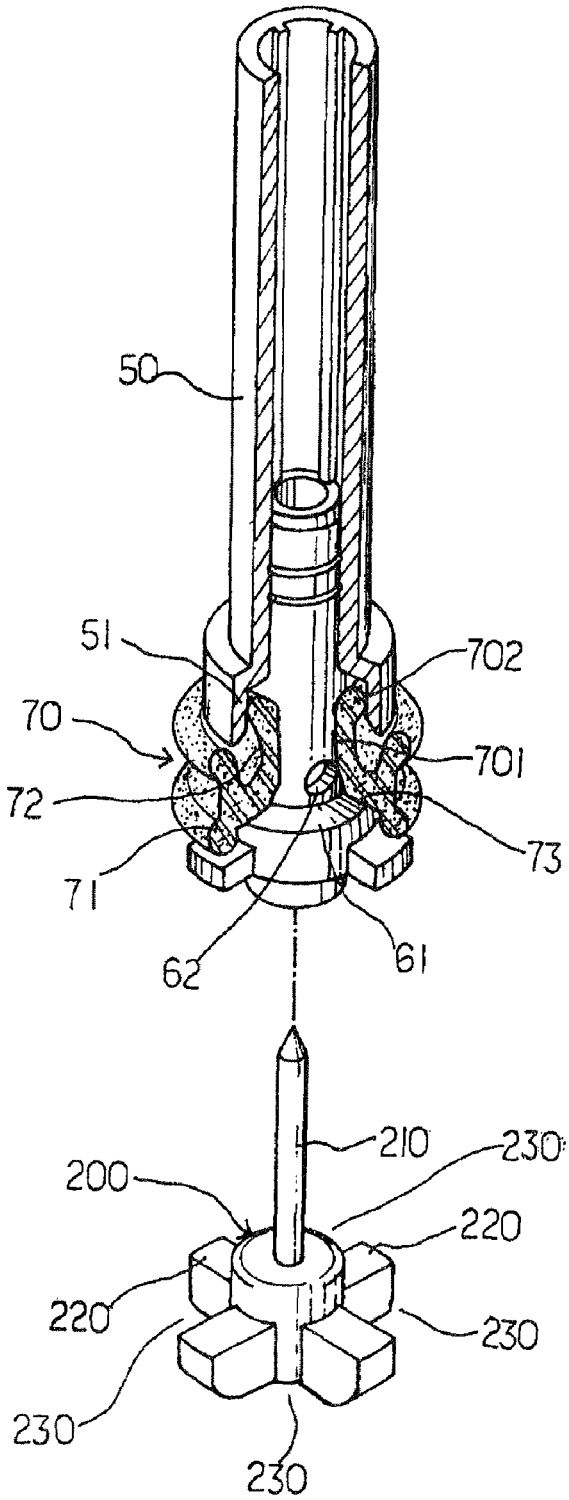
FIG. 10 is a disassembled perspective view illustrating a pump piston and a ball valve support according to the present invention.

FIG. 2 shows a state that the nozzle head 20 is pressed for discharging contents. As the nozzle head 20 moves down, the piston shaft 50 moves down, and the return spring 40 is contracted, and the pump piston holder part 51 provided at the lower side of the piston shaft 50 moves down and closely contacts with the second content discharge prevention surface 702 formed on the upper surface of the insertion part 72 of the pump piston 70. The first content discharge prevention surface 701 formed in a "()"-shape by the pressure applied to the second content discharge prevention surface 702 is contracted in an arrow shape in the direction of the outer wall of the stem 60 and is closely contacted with the outer wall of the stem 60. The second content discharge prevention surface 702 is expanded in an outward direction in an arrow direction T2 and is closely contacted with an inner surface of the holder part 51 of the piston shaft 50. The pump piston lower end contact surface 61 provided in the stem 60 and the content opening and closing surface 73 formed at the lower surface of the pump piston 70 are separated from each other, so that the content is inputted. The guide rod 210 of the ball valve support inserted into the guide rod insertion hole 63 formed at the stem 60 moves down along the stem 60 by the friction force of the guide rod insertion hole 63, and the lower surface of the ball valve support 200 slightly presses the ball valve, so that the first content inlet hole 33 is reliably closed.

The content of the pump cylinder 31 is transferred to the second content inlet hole 62 formed in the stem 60, and the transferred content is inputted into a plurality of content flow grooves 123 formed on the inner surface of the valve member cover body 120. As the content opening and closing plate 121 closing the content discharge hole 121 formed in the valve member cover body 120 is forcibly opened by means of the discharge pressure of the content, so that the content is discharged. In a state that the nozzle head 20 is last moved down, the ball valve support 200 strongly pressurizes the ball valve 34, so that the flow in the direction of the content storing container 10 is closed.

When the moved down nozzle head 20 is released after the content discharge is completed, the nozzle head 20 moves up by the return spring 40. As the nozzle head 20 moves up, the ball valve support 200 moves up, and the ball valve 34, which closed the first content inlet hole 33, is open, and the content inputted into the first content inlet hole inputted by means of the suction pressure of the pump piston 70 is inputted into the pump cylinder via the content path 230 between the support ribs 220 formed at the ball valve support 200. When the stem 60 starts moving up by means of the friction pressure between the content compression rib 71 of the pump piston 70 and the inner surface of the pump cylinder 71, in a state that the pump piston 70 stops, the pump piston lower side contact surface 61 of the stem 60 is closely contacted with the content opening and closing surface 73 of the lower surface of the pump piston 70 for thereby closing the inlet of the contents. When the content of the content storing container 10 is inputted into the pump cylinder 31, the content compression piston 30 moves down.

The content opening and closing plate 121 integrally engaged with the content opening and closing valve member 130 has an excellent elastic force and an excellent recovery force. When a recovery pressure of the content is not applied, it keeps tightly closing the content discharge hole 121, and the sealing state is very excellent, so that the input of an external air and foreign substance is substantially closed, and it is possible to prevent an oxidation and decay or change in quality. In particular, the content opening and closing valve member 130 and the pump piston 70 are preferably made of medical rubber materials which have excellent durability, flexibility and recovery property and produce less environment hormone components.

As described above, the present invention is able to basically prevent the input of an external air or foreign substance with the help of special construction of a content discharge nozzle part while preventing a unnecessary leakage of content by improving the structure of the content pump piston. A reliable opening and closing operation of the ball valve can be obtained by adapting a ball valve support.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In an airless dispensing pump container with an airtight nozzle head of a push down type which includes a content storing container 10 for storing liquid content therein, a nozzle head 20 which is assembled at an upper side of the content storing container 10 and has a nozzle engaging hole 21, a content compression piston 30 which is received in the content storing container 10 and is formed at a lower side, a pump cylinder 31 which is provided at a center portion, a pump cylinder cap 32 which is covered on an upper side of the pump cylinder 31, a first content inlet hole 33 which is provided at a lower center of the pump cylinder 31, a ball valve 34 which opens and closes the first content inlet hole 33, a ball valve support shoulder 35 provided at a lower inner wall of the pump cylinder 31, a nozzle head return spring 40 which is installed between the nozzle head 20 and the pump cylinder cap 32, a pump piston shaft 50 which is fixedly assembled at an inner center of the nozzle head 20 and has a pump piston holder part 51 at a lower side, a stem 60 which is fixed at a lower side of the pump piston shaft 50 and has a pump piston lower end contact surface 61, a second contact inlet hole 62, and a ball valve support guide rod insertion hole 63, a pump piston 70 which is inserted into the stem 60 and includes an insertion part 72 sliding up and down as being inserted into the stem 60, and a content opening and closing surface 73 formed at a lower surface, an airless dispensing pump container with an airtight nozzle head of a push down type, comprising:

- a content discharge means 100 which is installed at a content discharge means engaging hole 21 of the nozzle head 20;
- a ball valve support 200 which is engaged at a lower side of the stem 60; and
- a content compression piston support shoulder 300 which is provided at an inner upper wall of the content storing container 10 wherein said content discharge means 100 comprises:

- a valve member support protrusion 110 which is integral with the nozzle head 20 and is positioned at the center of the content discharge means engaging hole 21;
- a valve member cover body 120 which is fixedly inserted into the content discharge means engaging hole 21 and has a content discharge hole 121 at its front center portion; and
- a content opening and closing valve member 130 which is inserted into the valve member cover body 120 and is supported by means of the valve member support protrusion 110.

2. The container of claim 1, wherein said valve member cover body 120 comprises:

- a plurality of ribs 122 formed in its inner surface at regular intervals; and
- a plurality of content flow groves 123 formed between the ribs 22.

3. The container of claim 1, wherein said content opening and closing valve member 130 comprises:

- a content opening and closing plate 121 which is provided at its front side for opening and closing the content discharge hole 121 of the valve member cover body 120; and
- a support plate 132 which is supported by means of the valve member support protrusion 110.

4. The container of claim 1, wherein said insertion part 72 of the pump piston 70 is formed in a "))(" shape in its cross section, with an intermediate portion of the same being defined as a first content discharge prevention surface 701, with an upper surface portion being defined as a second content discharge prevention surface 702.

5. The container of claim 1, wherein said ball valve support 200 comprises:

- a guide rod 210 which is inserted into a ball valve support guide rod insertion hole 63 of the stem 60;
- a plurality of ball valve support ribs 220 which are provided at a lower side of the guide rod 210; and
- a content path 230 which is provided between the ball valve support ribs 220.

6. The container of claim 1, wherein said airless dispensing pump container with an airtight nozzle head of a push down type characterized in that as the ball valve support 200 moves down by means of a friction force between an outer wall of a guide rod 210 of a ball valve support 200 tightly inserted into the guide rod insertion hole 63 and an inner wall of a guide rod insertion hole 63 when a stem 60 moves down, a lower surface of the ball valve support 200 slightly presses a ball valve 34 for thereby closing a first content inlet hole 33.

* * * * *